US006230909B1

(12) United States Patent
Suter

(10) Patent No.: US 6,230,909 B1
(45) **Date of Patent: *May 15, 2001**

(54) MODULAR SHELVING ASSEMBLY INCLUDING U-SHAPED STRUCTURAL BASE UNITS

(75) Inventor: Adolf Suter, Gipf-Oberfrick (CH)

(73) Assignee: Andreas Dornbierer, Gipf-Oberfrick (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/913,223

(22) PCT Filed: Mar. 7, 1996

(86) PCT No.: PCT/CH96/00083

§ 371 Date: Sep. 10, 1997

§ 102(e) Date: Sep. 10, 1997

(87) PCT Pub. No.: WO96/28067

PCT Pub. Date: Sep. 19, 1996

(30) Foreign Application Priority Data

Mar. 10, 1995 (CH) ..... 689/95

(51) Int. Cl.[7] ..... A47B 47/00

(52) U.S. Cl. ..... 211/188; 211/189; 211/194; 108/91

(58) Field of Search ..... 211/186, 188, 211/182, 189, 194; 108/91, 108, 182, 158.11, 153.1; 312/107, 108, 111

(56) References Cited

U.S. PATENT DOCUMENTS

| | | | | |
|---|---|---|---|---|
| 2,615,771 | * | 10/1952 | Curtis | 108/159 |
| 3,426,913 | * | 2/1969 | Abatiell | 211/194 |
| 3,790,241 | * | 2/1974 | Messina | 312/111 |
| 3,841,725 | * | 10/1974 | Dorner | 312/107 |
| 3,861,327 | * | 1/1975 | Silson | 211/188 X |
| 3,945,497 | * | 3/1976 | Greenberg | 211/70.4 |
| 4,099,472 | * | 7/1978 | Kellogg | 211/186 X |
| 4,321,873 | * | 3/1982 | Nealis | 108/91 |
| 4,836,393 | * | 6/1989 | Maye | 211/188 |
| 5,123,552 | * | 6/1992 | Aggelen | 211/194 |
| 5,269,419 | * | 12/1993 | Aldeguer et al. | 211/186 X |
| 5,492,399 | * | 2/1996 | Tillack | 312/111 |
| 5,746,139 | * | 5/1998 | Villanueva | 211/188 X |
| 5,752,610 | * | 5/1998 | Remmers | 211/186 X |

FOREIGN PATENT DOCUMENTS

| | | | | |
|---|---|---|---|---|
| 2803302 | * | 8/1979 | (DE) | 312/111 |

* cited by examiner

*Primary Examiner*—Daniel P. Stodola
*Assistant Examiner*—Gregory J. Strimbu
(74) *Attorney, Agent, or Firm*—Wenderot, Lind & Ponack, L.L.P.

(57) ABSTRACT

A modular shelving assembly includes at least two U-shaped base units. Each base unit includes a base plate having side walls extending transversely from opposite ends thereof. Fittings are provided at free ends of the side walls and at opposite ends of the base plates. The two base units are capable of being assembled in a laterally staggered and overlapped orientation with a portion of one base unit fitting in the other base unit. A distance holder is engageable with a free end of one side wall of the one base unit that is laterally spaced from the other base unit.

9 Claims, 3 Drawing Sheets

MODULAR SHELVING ASSEMBLY INCLUDING U-SHAPED STRUCTURAL BASE UNITS

BACKGROUND OF THE INVENTION

The present invention relates to a modular shelving assembly including structural units.

Such a structural unit is known. As a rule shelving is made by placing such units vertically on top of and/or laterally next to one another. To a limited extent the units can also be positioned offset to one another, which however causes the shelving to become narrower from the bottom upwards. Another disadvantage is that the width of the shelving can only be changed in steps as an integral multiple of the width of a unit.

DE-U-93 02 558 discloses a shelving system having a U-shaped base element with a base plate and outer supporting walls. On small sides of the supporting walls, as well as on opposite sides, are arranged spaced which are formed as blind holes. Into these blind holes can be put connecting elements, through which modular units can be fixed one upon another. Each of the connecting elements has in its middle sector a distance or spacing part. For the connection of modular units side by side are used H-shaped connecting elements, which on the one hand fix modular units one on the top of the other, and on the other hand fix modular units arranged side by side. This known shelving system enables two or several modular units to be stapled one on another and moreover two or several units to be put in a row side by side. However, shelving cannot be put gradually together in any manner regarding width and height. Modular units rather only can be put side by side. The width of the shelving can be varied in a restricted manner by different widths of the modular units. But the use of different dimensioned modular unit leads to higher costs for manufacture and storage. Furthermore, this known shelving system has an additional disadvantage in that between two modular units connected one upon another exists a gap. Also, modular units put side by side always have a space therebetween. This is not practical and moreover is not aesthetic. Further, it is of significance that the connecting elements of this system enable the fixation of the modular units, but the main purpose of these connecting elements is to enable the use of H-shaped connecting elements and to obtain a certain total height with different modular units.

SUMMARY OF THE INVENTION

It is, therefore, the object of the invention to improve a structural unit of the above type and to provide a modular shelving assembly in such a way that shelving can be made in an infinitely variable number of widths.

As a result of the invention it is possible to place two elements with oppositely directed side walls on top of or into one another in infinite variable overlapping arrangements and to compensate for height differences between supports of side walls of top elements caused by the thickness of base plates of bottom elements by distance holders.

BRIEF DESCRIPTION OF THE DRAWINGS

Exemplified embodiments of the invention are explained in the following with reference to the attached drawings, wherein.

DETAILED DESCRIPTION OF THE INVENTION

Figure 1:
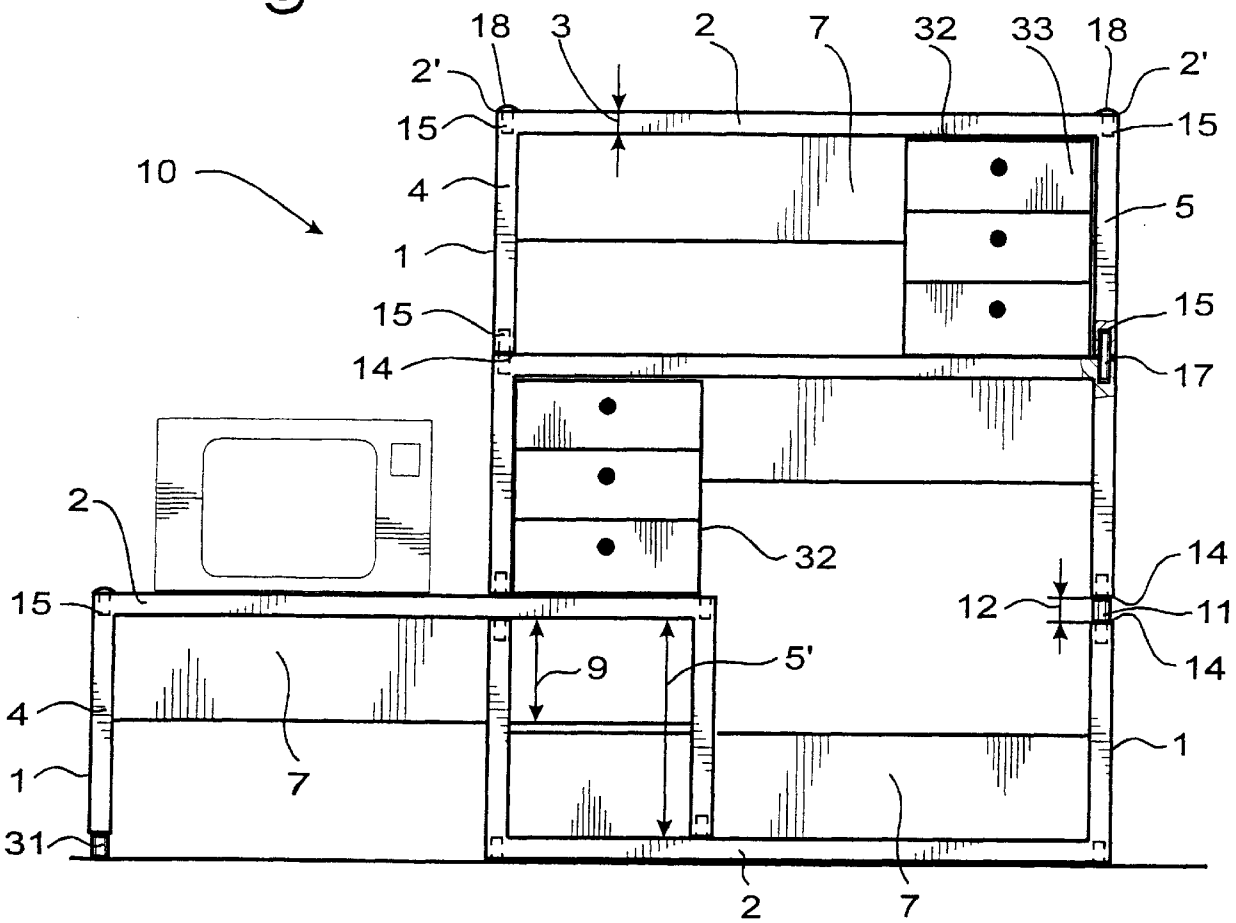
FIG. 1 is a front view of shelving according to the invention comprising several base elements.

FIG. 1 illustrates shelving assembly 10 including plural structural units according to the invention. The shelving is made up of four U-shaped base units 1 and, placed inside the same, two cupboard units 32 with three drawers 33 each. Each base element 1 has a transversely positioned base plate 2 with a thickness 3 which is dimensioned such that under the stresses which normally occur on book shelves it will not or only slightly bend. At opposite lateral ends of the base plate 2, to form the U-shape of the base unit 1, rectangularly projecting side walls 4, 5 are provided, which side walls 4, 5 together with the base plate 2 form one single unit. However, these side walls may also be attached flush to the base plate and be fastened by detachable quick-release catches in the form of a bayonet or push-button catch, as is common in the assembly of furniture parts. Such a base unit can, therefore, be dismantled into individual parts and be packed in a compact manner.

According to the invention, each U-shaped base unit 1 is provided, on outside 2' of the base plate 2 and on the opposite bearing or end surfaces 14 of the side walls 4, 5, with fittings 15, two opposite fittings 15 being in each instance arranged in line with one another. These fittings 15 each can hold a distance 11, 31, a centering pin 17, a cap 18, or the like.

With a very advantageous assembly, two base units 1 can be placed on top of one another with oppositely, upwards or downwards directed side walls 4, 5, or they can be placed inside one another with the side walls 4, 5 pointing in the opposite directions. As the two bottom base units in FIG. 1 show, when two base units 1 are placed inside one another a height difference occurs caused by the thickness 3 of the base plate 2 of the bottom base unit 1. This is compensated by distance holders 31 placed in the fittings 15 on one side of the left base unit. The height 12 of holder 31 is the same as the thickness 3 of the base plate 2. Another distance holder 11 is put into the one fitting 15 at one bottom end surface 14 of the middle base unit 1, as a result of which this unit is securely held on the bottom unit. The top base unit 1 is placed on the middle unit in the same alignment with the side walls pointing downwards. The fittings 15 of these base units are fit together with centering pins 17 to ensure a secure holding together of such two units. The arrangement of the two bottom base units 1 placed inside one another with opposite side walls 4, 5 together with the distance holders 31, permits the length of the shelving assembly formed by these base units to be changed in an infinitely variable manner, so that the shelving assembly can be adapted to individual requirements and available space.

To the rear of the base unit 1 preferably is fastened a rear wall 7 which has a height 9 not greater than half the height 5' of the side wall 4, 5. Thus, the rear walls, when two base units 1 are placed inside one another, adjoin one another practically without any gap therebetween and form a practically closed rear wall, as illustrated by the two bottom base units in FIG. 1. This rear wall moreover offers the advantage that the two base units are centered relative to one another with regard to their depth, as the side wall engaging into the other base unit can be pushed against this rear wall.

Figure 2:
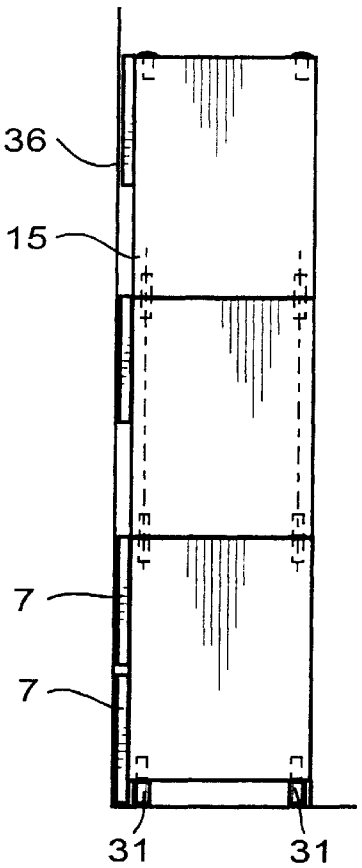
FIG. 2 is a side view of the shelving according to FIG. 1.

According to FIG. 2 the shelving assembly 10 is placed against a wall 36 or the like. For a side wall 5 of a base unit 1, two fittings 15 each are provided at the top and bottom of wall 5, two of which in each instance lie opposite one another in an aligned arrangement. To increase the stability of the shelving assembly 10, more than two fittings 15 can be arranged on each side.

Figure 3:
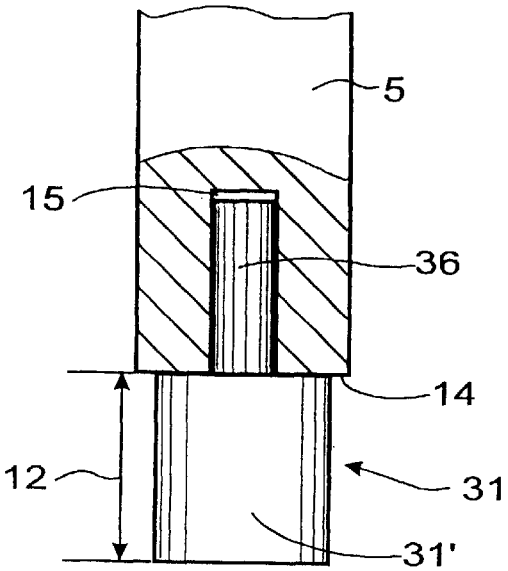
FIG. 3 is a view of a distance holder which is mounted in a partly illustrated base element.

FIG. 3 shows the mounted distance holder 31. It consists of a cylindrical distance part or spacer 31' and a centering pin 36 with a smaller diameter which forms a coaxial extension of the former, wherein they preferably form an integral part. The distance part 31' has height 12 equal to the thickness of the base plate 2.

Figure 4:
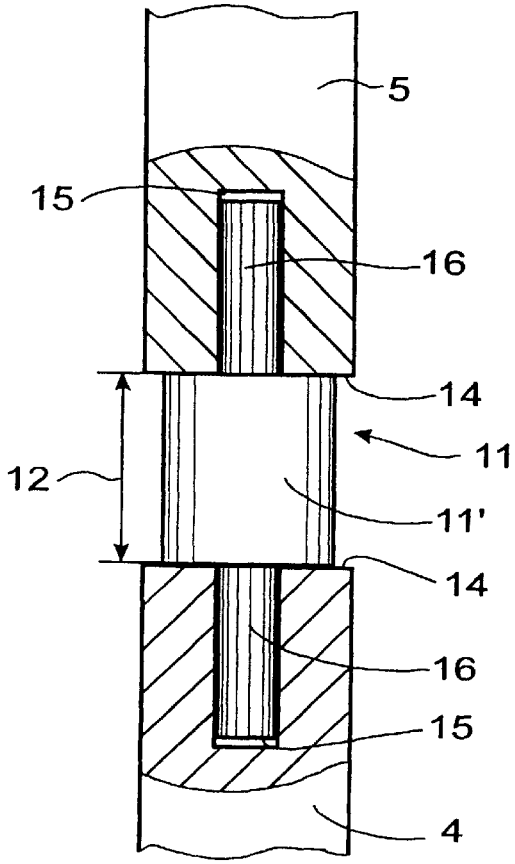
FIG. 4 is a similar view of another distance holder for the shelving according to FIG.

According to FIG. 4, to compensate for the height difference between two base units 1 placed on top of one another, the distance holder 11 is provided between two side walls 4, 5. Distance holder 11 has a distance part or spacer 11' with height 12 and two centering pins 16 arranged coaxially thereto, and each of which engages into a fitting 15 and prevents the two base units from shifting in relation to one another. Centering pins 16 preferably are identical to the above-mentioned centering pin 36, so that optionally a distance holder 11 or 31 can be put into any one of the fittings. The diameter of the cylindrical distance part 11, when the fittings are provided centrally in the side walls, is the same as or smaller than the thickness of the side walls 4, 5. Thus, parts 11' do not project from the side walls. Furthermore, their cross-section instead of being cylindrical, may also be rectangular, lath-shaped or any other shape.

Figure 5:
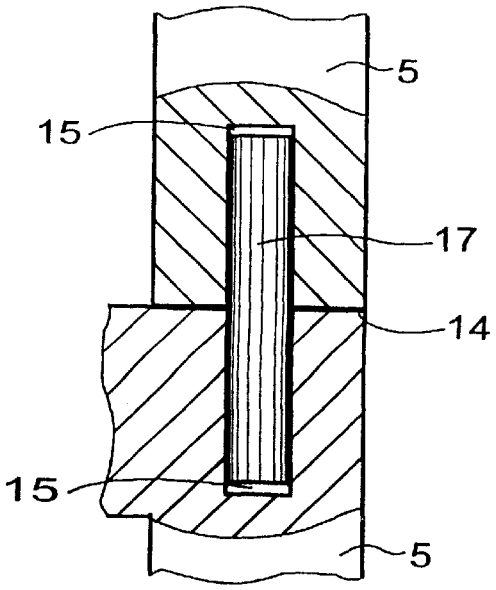
FIG. 5 is a view of a centering pin which positions two partly illustrated base elements relative to one another.

FIG. 5 shows two adjoining side walls 5 of base units 1 which are placed directly on top of one another and the position of which relative to one another is secured by the centering pins 17 which are placed in two aligned fittings 15. The centering pins 17 preferably are the same as the centering pins 16, so that they can be put in by hand and are held in the fittings. In principle, side walls 4, 5, instead of being secured by centering pins 17, could also be secured by distance holders 11. As a result, the side walls would not rest directly on top of one another, but there would be a space between them which may be preferred for aesthetic reasons.

Figure 6:
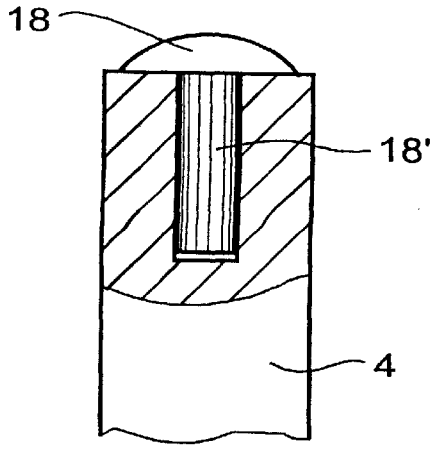
FIG. 6 is a view of a cap on a base element.

As shown in FIG. 6, unused visible fittings 15 preferably are protected by plug-in caps 18. Each cap 18 has a centering pin 18', which preferably is identical to the above-mentioned centering pin 16.

The centering pins 16, 36, 18' of the distance holders 11, 31 and the cap 18, respectively, as well as of the centering pins 17, have an outside diameter which preferably is such that together with the fittings 15, each consisting of a cylindrical blind bore, they form press fits. Thus, distance holders 11, 31, the caps 18 and the centering pins 17 preferably can be put into the fittings by hand and are held therein by resultant self-locking, and can be pulled out again by hand. A prerequisite for this, however, is that the centering pins 16, 18', 36, as well as the fittings 15, are produced with exact tolerances, at least in a range of a tenth of a millimeter.

Figure 7:
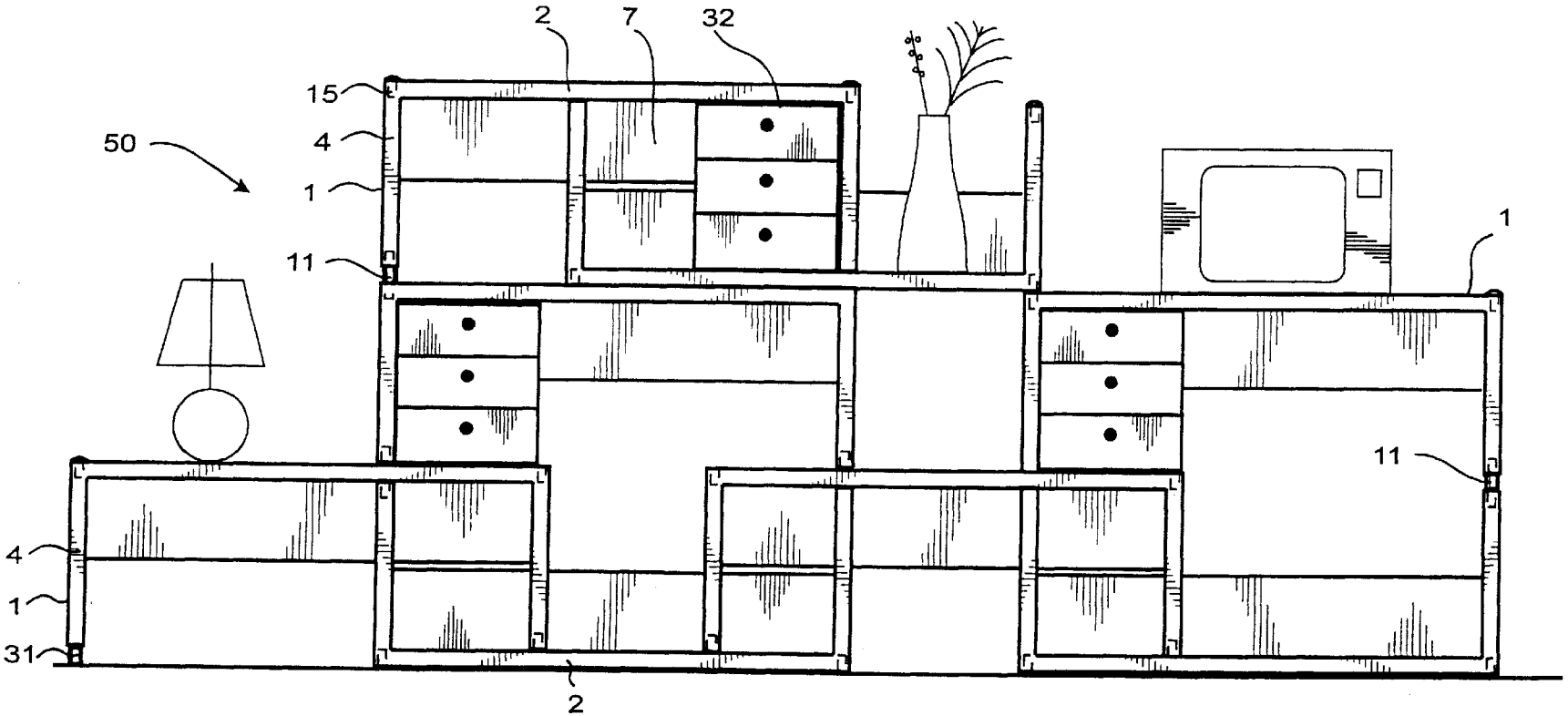
FIG. 7 is a diagrammatic illustration of completed shelving.

FIG. 7 shows shelving 50, which illustrates the many possibilities of combination when assembling structural units according to the invention in the home or workplace. FIG. 7 shows the great flexibility with regard to design of shelving and room use obtained with the invention. The flexibility also makes possible quick assembly, change or addition to the shelving and the use of the shelving as a wall unit or room divider. With the shelving assembly 50, eight base units 1 are placed inside or on top of one another, and in addition three cupboards are provided.

It goes without saying that the invention could be exemplified by further embodiments. Thus, the fittings as well as the pins engaging therein may have shapes other than cylindrical. For example, instead of plug-n pins, screw connections or the like may be provided. As distance holders, instead of a cylindrical distance part, it is also possible to provide a lath, the longitudinal section of which preferably is about the same as the cross-section of a side wall.

These structural units may be made of wood, sheet metal or plastic. The shelving made from these structural units is suitable for use in the home and office. The base elements can also be fitted with desk tops or different types of cupboards than those that are illustrated. Structural units according to the invention also can be produced as miniatures and accordingly are also suitable as toys in the field of dolls or the like. In contrast to the construction in the furniture field, where the base units have a length of, for example, 70 cm, for toys they have a length of, for example, 10 to 15 cm.

I claim:

1. A modular shelving assembly comprising:

at least first and second U-shaped base elements, each said base element comprising:

a base plate having opposite first and second ends;

side walls extending transversely to said base plate from respective said opposite ends of said base plate;

each said side wall having a first end adjacent a respective said end of said base plate and forming a juncture with said respective end of said base plate;

each said side wall having a free second end spaced from said base plate;

at least one fitting adjacent each said juncture; and at least one fitting at each said free second end;

said first and second base elements being capable of being assembled in an orientation with:

said first base element being oriented with said base plate thereof located downwardly and said two side walls thereof being directed upwardly therefrom;

said second base element being oriented with said base plate thereof located upwardly and said two side walls thereof being directed downwardly therefrom; and said second base element being laterally staggered relative to said first base element with:

a first said side wall of said second base element supported on said base plate of said first base element;

said base plate of said second base element supported on a first said side wall of said first base element;

a second said side wall of said second base element spaced laterally beyond said first side wall of said first base element; and said free second end of said second side wall of said second base element being spaced by a gap above a level of a bottom surface of said base plate of said first base element, said gap having a dimension equal to a thickness of each of said base plates of said base elements; and at least one distance holder engageable with said at least one fitting at said free second end of said second side wall of said second base element, said distance holder including a spacer having a height equal to said thickness of each of said base plates of said base elements, said spacer being fitable in said gap.

2. An assembly as claimed in claim 1, further comprising:

a third base element including a base plate having opposite first and second ends, a thickness and side walls extending transversely to said base plate of said third base element from respective said opposite ends thereof;

said third base element being capable of being assembled with said first and second base elements, when said first and second base elements are in said orientation, with:

said base plate of said third base element being located upwardly and said two side walls of said third base element being directed downwardly and in vertical alignment with said two side walls of said first base element;

a first said side wall of said third base element being supported on said base plate of said second base element, such that said base plate of said second base element is positioned between said first side wall of said first base element and said first side wall of said third base element; and a free second end of a second said side wall of said third base element confronting said free second end of a second said side wall of said first base element with a space therebetween; and at least one further distance holder engageable with said at least one fitting at said free second end of said second side wall of said first base element and at least one fitting at said free second end of said second side wall of said third base element, said at least one further distance holder including a further spacer having a height equal to said thickness of each of said base plates of said base elements, such that said further spacer is fittable in said space.

3. An assembly as claimed in claim 2, wherein said at least one further distance holder further includes pins extending from opposite sides of said further spacer and engageable with respective said confronting free second ends of said second side walls of said first and third base elements.

4. An assembly as claimed in claim 1, wherein said at least one fitting adjacent each said juncture comprises plural fittings adjacent each said juncture, and said at least one fitting at each said free second end comprises plural fittings at each said free second end.

5. An assembly as claimed in claim 1, wherein each said fitting comprises a bore.

6. An assembly as claimed in claim 5, wherein said at least one distance holder includes a pin fittable into said bore of said at least one fitting at said free second end of said second side wall of said second base element.

7. An assembly as claimed in claim 1, wherein each of said at least first and second base elements further comprises a rear wall adjoining said base plate and flush therewith, said rear wall having a height equal substantially to one-half a height of each of said side walls.

8. An assembly as claimed in claim 1, further comprising caps engageable with any exposed said fittings.

9. An assembly as claimed in claim 1, wherein said at least first and second base elements are capable of being assembled in a further orientation of being stacked one on the other with respective said fittings of said at least first and second base elements facing each other, and further comprising centering pins engageable in said respective fittings facing each other when said at least first and second base elements are assembled in said further orientation.

* * * * *